US006139129A

United States Patent [19]

Tabasso et al.

[11] Patent Number: 6,139,129

[45] Date of Patent: Oct. 31, 2000

[54] INK-JET PRINTER HAVING A MAINTENANCE STATION ASSEMBLY

[75] Inventors: Alain Tabasso, Essertines; Georges Zoganas, Lausanne, both of Switzerland; Alessandro Scardovi, Ivrea, Italy

[73] Assignee: Olivetti Lexikon, S.p.A., Ivrea, Italy

[21] Appl. No.: 09/162,505

[22] Filed: Sep. 29, 1998

[30] Foreign Application Priority Data

Oct. 2, 1997 [CH] Switzerland ..... 2307/97

[51] Int. Cl.[7] ..... B41J 2/165

[52] U.S. Cl. ..... 347/33; 347/29

[58] Field of Search ..... 347/33, 29, 30

[56] References Cited

U.S. PATENT DOCUMENTS

| | | | |
|---|---|---|---|
| 5,155,497 | 10/1992 | Martin et al. | 347/33 |
| 5,712,668 | 1/1998 | Osborne et al. | 347/32 |
| 5,946,009 | 8/1999 | Youn | 347/32 |
| 5,984,451 | 11/1999 | Muraki | 347/29 |

FOREIGN PATENT DOCUMENTS

| | | |
|---|---|---|
| 362897 | 4/1990 | European Pat. Off. . |
| 410691 | 1/1991 | European Pat. Off. . |
| 480302 | 4/1992 | European Pat. Off. . |
| 510894 | 10/1992 | European Pat. Off. . |
| 597505 | 5/1994 | European Pat. Off. . |
| 597621 | 5/1994 | European Pat. Off. . |
| 195 31 352 A1 | 8/1996 | Germany . |

*Primary Examiner*—N. Le
*Assistant Examiner*—Shih-wen Hsieh
*Attorney, Agent, or Firm*—Banner & Witcoff, Ltd.

[57] ABSTRACT

The printer comprises a maintenance assembly station (18) in the form of a compact module with a support (30) upon which two maintenance assemblies (27, 28) are mounted, each comprising a sealing member (20) suitable for being applied against a printhead, a wiping member (22) for wiping the printhead and a cleaning member (24) for removing the ink from the wiping members (22). A suction member (26) is arranged between the two assemblies (27, 28) and connected by flexible pipes (41, 42) to the sealing members, in which it enables a sucking effect to be created. A camshaft (31) is fitted centrally in the support (30) parallel to the direction of movement of the carriage, is driven by a motor and controls the entire range of movements and functions of all the movable members of the maintenance assembly station.

8 Claims, 5 Drawing Sheets

INK-JET PRINTER HAVING A MAINTENANCE STATION ASSEMBLY

FIELD OF INVENTION

This invention relates to an ink-jet printer comprising a chassis, a movable carriage bearing at least one printhead and suitable for being moved according to a direction of movement and a maintenance assembly station comprising at least one sealing member intended to be applied against the printhead and a wiping member for wiping the ink off the printhead.

In ink-jet printers, it is common practice to protect the ink emission nozzles of the printhead, when they are in the idle position for a considerable length of time between printing periods, in order to prevent the ink from drying and clogging the nozzles.

For this purpose, a cap is applied against the front plate of the nozzles and this maintains a certain degree of humidity.

U.S. Pat. No. 5,155,497 describes a maintenance assembly station for a printer with interchangeable printheads. This station comprises a support rotating at 180° about an axis parallel to the direction of movement of the carriage and upon which two caps are mounted in opposite positions by means of two slides which can be moved longitudinally along this direction of movement of the movable carriage. Upon detection of the type of printhead mounted on the carriage, the rotating support performs a rotation to put the slide and the cap that correspond to the head in position, and the carriage then moves the slide longitudinally in order to apply the cap against the nozzle-carrying plate.

This maintenance assembly station is composed of a large number of parts and is difficult to construct. What is more, it cannot be integrated in existing printers and is not applicable on printers having two or more printheads mounted on the carriage at the same time.

SUMMARY OF THE INVENTION

The object of this invention is to produce a printer having a maintenance assembly station that is very easy to build, works reliably, has a low cost price, is suitable for integration in existing printers and applicable on printers with one, two or more printheads. The invention is characterized to this end by the fact that the maintenance assembly station comprises a camshaft fitted rotatingly with its axis oriented substantially parallel to the direction of movement and arranged so as to activate all the moving members of the maintenance station.

With these characteristics, a printer is obtained having a maintenance assembly station that is very easy to build and thoroughly suited to the functions to be accomplished, that works precisely and reliably, and that has a low cost price. The maintenance assembly station is suitable for integration without difficulty in existing printers and can be applied on printers with one, two or more printheads due to the fact that numerous movable members can be activated with a complex, precise timing mechanism.

To advantage, the maintenance assembly station comprises one or more sealing members, one or more wiping members, one or more cleaning members intended for removing the ink accumulated on the wiping members and at least one suction member connected to the sealing members to produce a sucking effect therein, all these members being fitted on the said module one after the other in the said direction and each activated by elements forming a cam integral with the said shaft.

Accordingly, a maintenance assembly station is obtained that is particularly effective and of reliable operation, protecting one or more printheads simultaneously.

A preferred embodiment is characterized by the fact that the maintenance assembly station comprises a module provided with a support constituting the body of the module wherein the said camshaft is fitted with an orientation parallel to the said direction of movement in a substantially central position, the said sealing, wiping and cleaning members each comprising a part fitted movably on the support, having a central aperture for the passage of the said camshaft and a portion intended for co-operating with the camshaft.

The maintenance assembly station thus possesses a particularly compact build, with low overall dimensions, while at the same time permitting precision control of the maintenance functions.

According to one favourable mode of construction of the invention, the active members of the camshaft are arranged so that a working cycle of the maintenance assembly station comprises the following steps:

a) idle position : the sealing members are in an active position, the suction member is armed, the wiping and cleaning members are in an inactive position;

b) the suction member is activated in the transition from the armed position to the non-armed position and a sucking effect is created in the sealing members;

c) the sealing members are withdrawn and the wiping members are put in the active position for wiping the printheads;

d) the suction member is rearmed, the cleaning members are put in the active position, while the wiping members are withdrawn and cleaned;

e) the cleaning members are put in the inactive position;

f) when the carriage is in position facing the maintenance assembly station, the sealing members are moved into the active position in order to restore the idle position a).

These characteristics permit extremely precise and effective operation of the maintenance assembly station of the printer.

Advantageously, the camshaft is made as one piece of a moulded, synthetic material.

This gives a low cost price, while also ensuring precision control over the maintenance functions.

BRIEF DESCRIPTION OF THE DRAWINGS

Other advantages will become apparent from the characteristics set down in the associated claims and in the more detailed description of the invention provided below, with the aid of drawings representing one embodiment schematically and by way of a non-limiting example.

DETAILED DESCRIPTION OF THE PREFERRED EMBODIMENT

Figure 1:
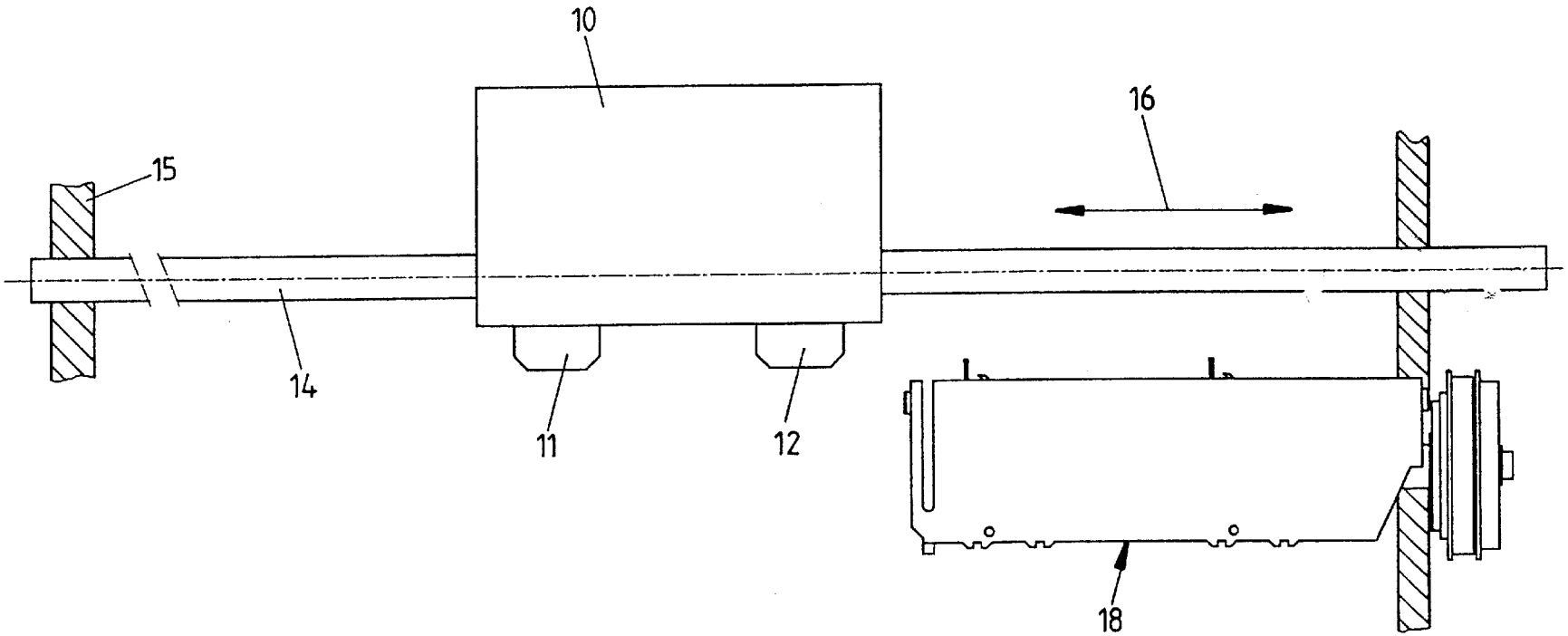
FIG. 1 is a schematic view of a part of the printer showing the maintenance assembly station.

The printer illustrated in FIG. 1 comprises a carriage 10 provided with two printheads 11, 12. This carriage is fitted slidingly on a shaft 14 affixed to the chassis 15 of the printer and moves backwards and forwards along a document to be printed according to a direction 16. The printer possesses a maintenance assembly station 18, disposed to one side outside the printing zone. This station consists of a compact module serving the two printheads, ensuring that they are cleaned, and also that they are sealed when in the rest position in order to prevent the ink from drying in the nozzles of the printheads and the nozzles from becoming clogged.

Figure 2:
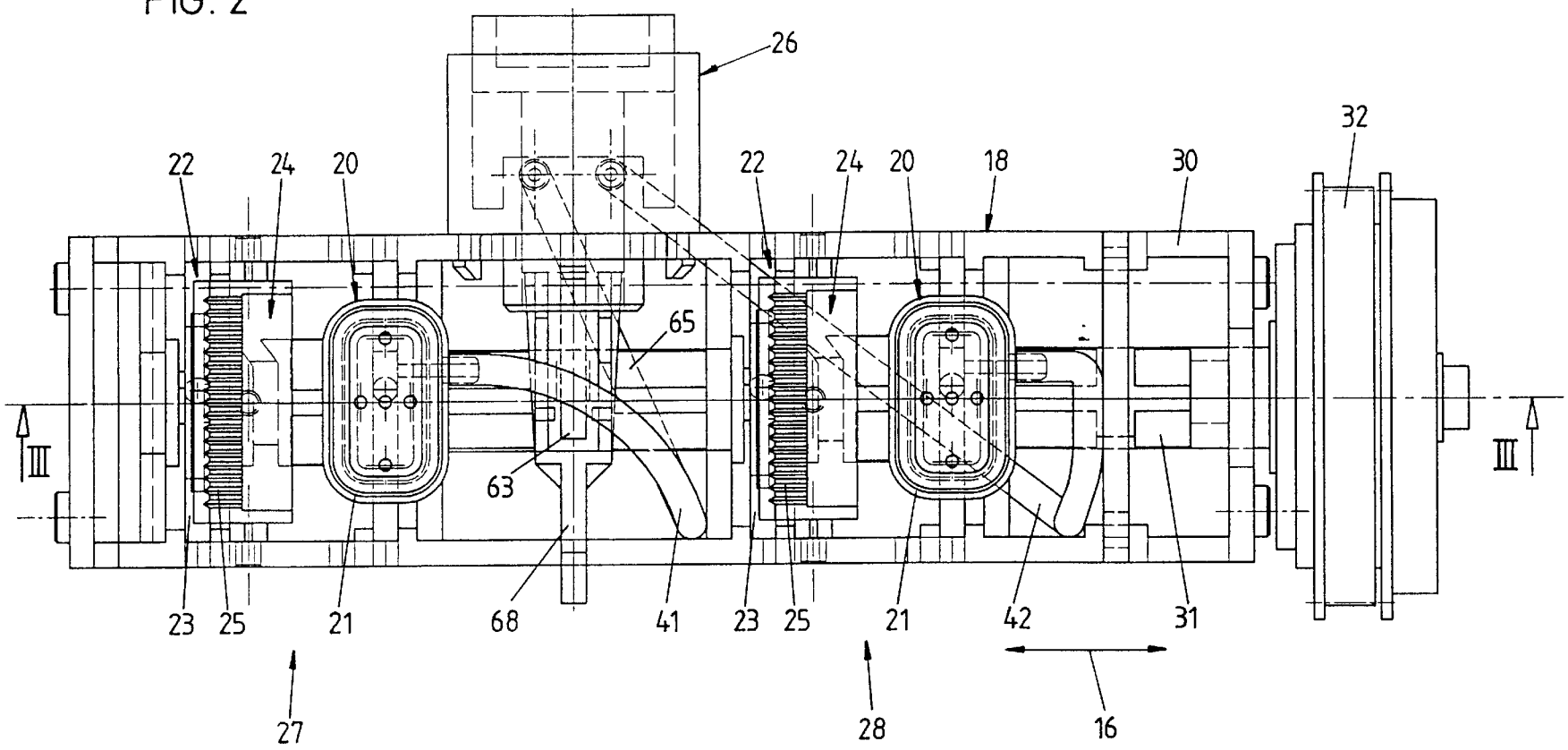
FIG. 2 is a plan view of the maintenance assembly station.
Figure 3:
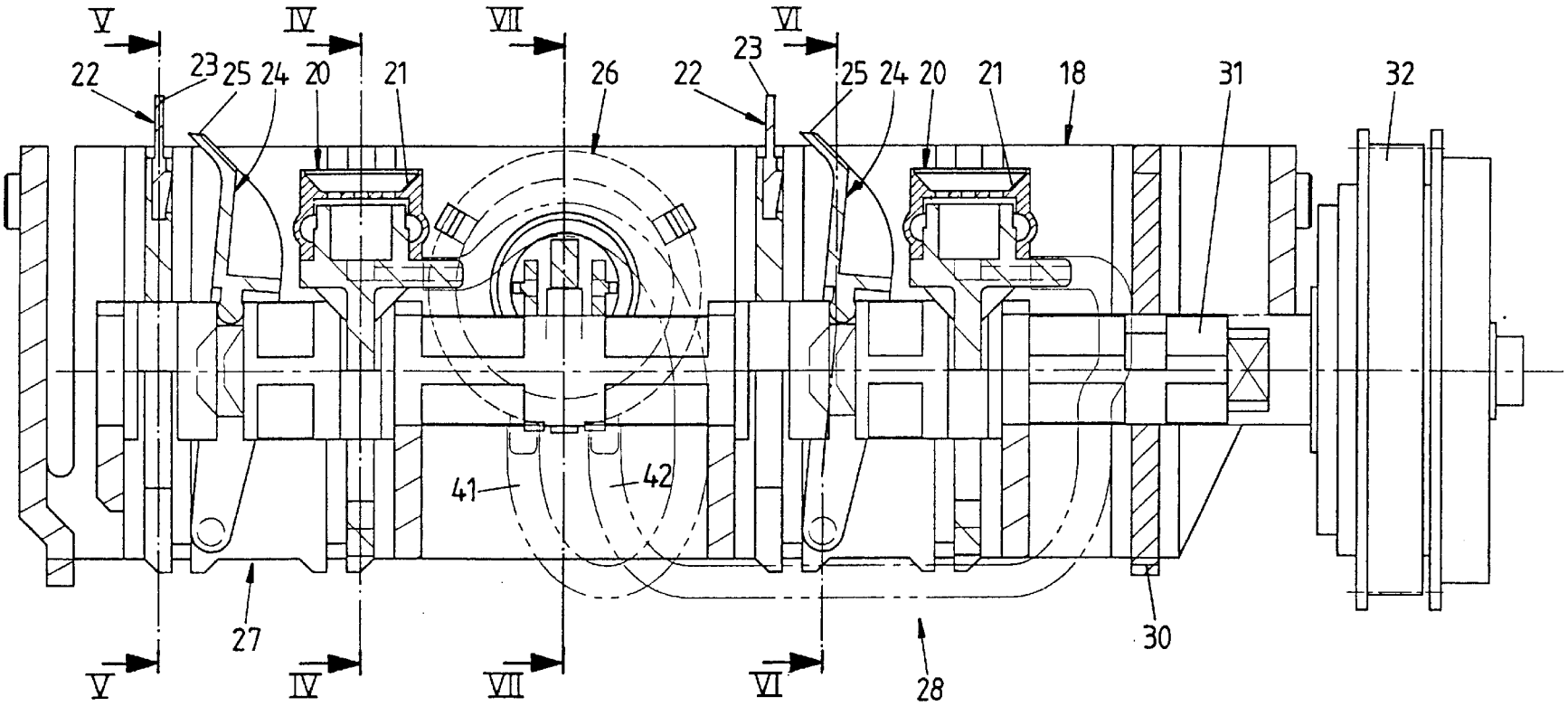
FIG. 3 is a cross-section view according to the plane II–III of FIG. 2.

With reference to the FIGS. 2 and 3, the maintenance assembly station 18 comprises two sealing members 20 in the form of caps 21 intended for covering the front part of the printheads, two wiping members 22 each comprising a flexible bib 23 intended for coming into contact with the front part of the heads and their nozzles in order to wipe the latter, two cleaning members 24 for the bibs 23 having a scraper 25 arranged so as to eliminate the ink accumulated on the bibs 23 and a suction member 26 intended for exercising a depression and a sucking effect on the nozzles of the printheads. All these members 20, 22, 24 and 26 are fitted on a support 30 constituting the body of the maintenance assembly station module.

They are disposed one after the other according to the direction 16 and are all activated by a single camshaft 31 connected by means of a friction coupling 32 to a drive motor not depicted. The camshaft 31 is fitted rotatingly on the support 30 of the module and arranged in an orientation parallel to the direction 16 of movement of the carriage 10. The shaft 31 and its seven cams are made as a single piece, for instance by the injection moulding of a synthetic material.

The maintenance assembly station 18 thus possesses two maintenance assemblies 27, 28 each consisting of a wiping member 22, a cleaning member 24 and a sealing member 20 fitted one after the other in the said direction 16, the suction member 26 being arranged between the two assemblies 27, 28.

Each of the sealing members 20 (FIG. 4) comprises a sliding part 35 fitted in grooves 36 in the support 30. This sliding part 35, in its upper part, has a wall 37 intended for receiving the cap 21, made of a flexible elastomeric material and arranged to be applied tightly against the front part of one of the two printheads 11, 12. The wall 37 with the cap 21 forms a chamber 39 having an outgoing end 40 connected by a flexible pipe 41 or 42 (FIGS. 2,3) to the suction member 26. An intermediate portion of the sliding part 35 is provided with a central aperture 44, allowing the camshaft 31 to pass. An intermediate edge 45 co-operates with the cam 55 of the shaft 31 and a spring 43 is arranged so as to urge the intermediate edge 45 against the cam 55.

Figure 4:
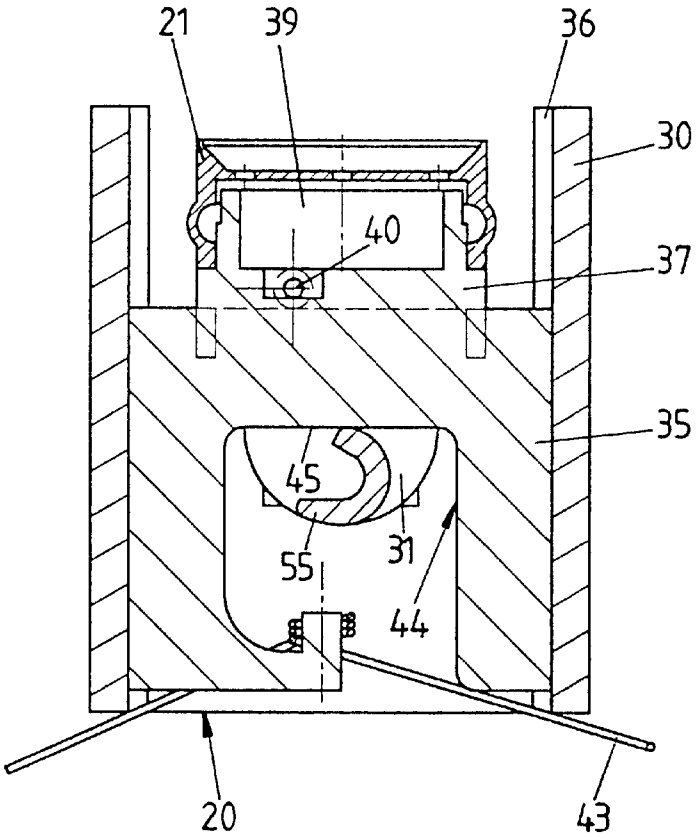

In the position illustrated in FIG. 4, the sliding part 35 is in the lower position. When the shaft 31 has turned by about 180°, the sliding part 35 is in the upper position, wherein the flexible cap 21 comes to rest against the face of the nozzles of one of the printheads 11, 12, which is thus sealed in order to prevent the ink from drying when the printer is in the idle position.

Figure 5:
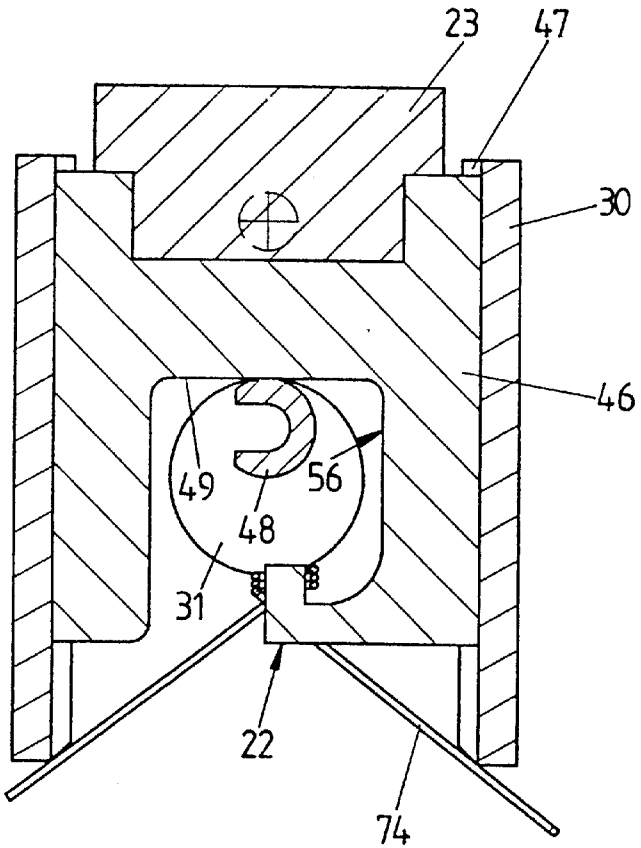
FIGS. 4 to 7 are cross-section views according to the planes IV—IV, V—V, VI—VI and VII—VII of FIG. 3.

With reference to FIG. 5, the wiping members 22 comprise a sliding part 46 arranged in grooves 47 in the support 30. The flexible bib 23 is affixed to the upper portion of this sliding part, while a spring 74 is arranged so as to urge an intermediate edge 49 of this sliding part 46 against a cam 48 of the shaft 31, which traverses the part 46 thanks to a central aperture 56.

In the position illustrated, the wiping member 22 is in its upper position and the flexible bib 23 sweeps the front face of the printhead and the nozzles when the latter moves past in front of the wiping member.

Figure 6:
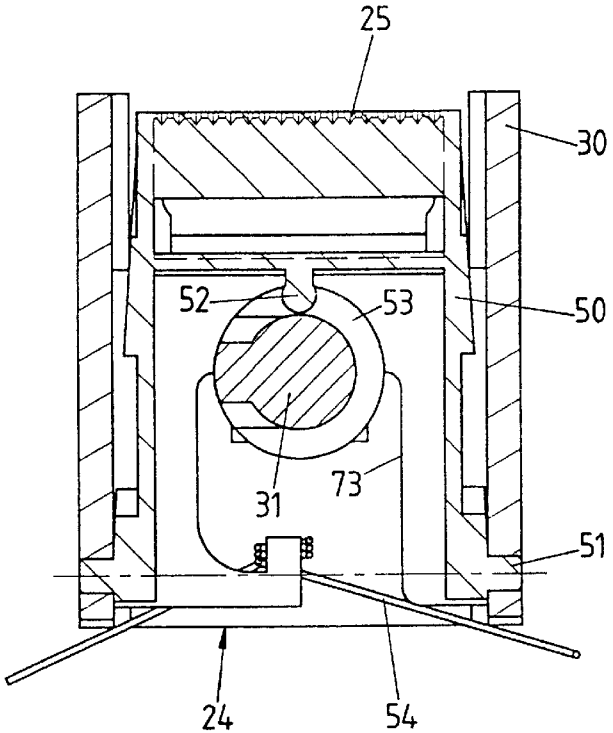

The cleaning members 24 depicted in FIG. 6 comprise a pivoting part 50, provided with two pivots 51 engaging in apertures made in the support 30. The upper portion of this pivoting part is chamfered in order to constitute the scraper 25. In its central portion, the pivoting part 50 is provided with a finger 52 engaging in a groove 53 in the shape of a cam of the shaft 31 and a spring 54 is arranged so as to urge this finger 52 against one of the faces of this groove in order to define a very precise position of the pivoting part 50. The camshaft 31 traverses the pivoting part 50 thanks to a central aperture 73. In the position illustrated in FIG. 6, the scraper 25 is disengaged from the bib 22. Following a rotation of about 90° in a right-handed direction, this scraper 25 is moved forward and gathers the ink deposited on the bib 23 while the latter is moved downwardly. The ink flows downwards thanks to the corrugated part of the scraper 25.

The sealing 20, wiping 22 and cleaning 24 members thus each consist of a part fitted movably on the support 30, having a central aperture 44, 56, 73 allowing the said camshaft 31 to pass and a portion 45, 49, 52 intended for co-operating with the camshaft 31.

Figure 7:
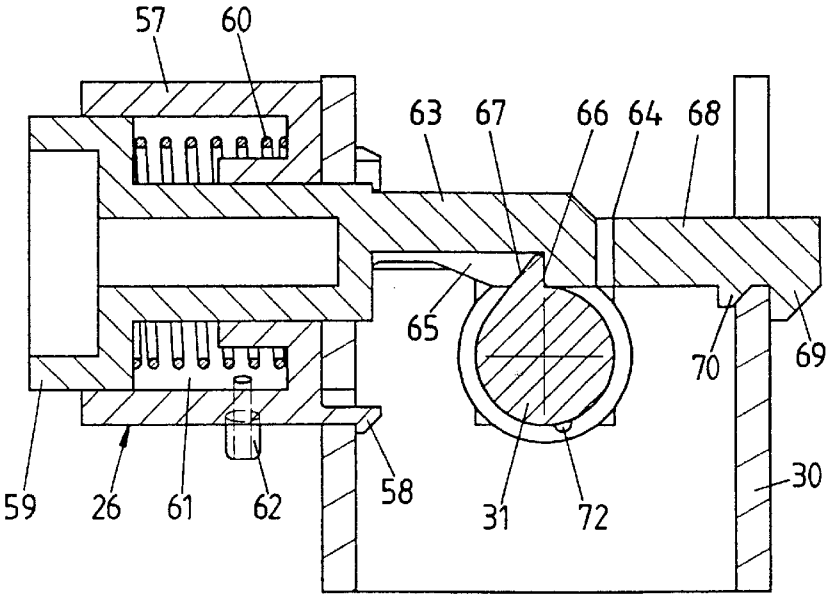

With reference to FIG. 7, the suction member or pump 26 comprises a cylinder 57 attached by three catches 58 to the support 30 and a piston 59 slidingly fitted in the cylinder 57 in opposition to a spring 60 housed in a chamber 61 of the cylinder. This chamber communicates through ends 62 with the flexible pipes 41, 42 connected to the sealing members 20. The piston 59 is provided with two activating pins 63, 64. The first pin 63 is shorter and is arranged between two branches 65 of the second pin 64. This first pin 63 comprises a step 66 suitable for co-operating with a lip 67 of the camshaft 31.

The second pin 64 is longer and flexible and comprises an end part 68 connected to the two branches 65 and is provided with two teeth 69, 70. In the non-armed position as illustrated in FIG. 7, the first, outer tooth 69 co-operates with the wall of the support 30 to maintain the piston 59 in this position in opposition to the effect of the spring 60. When the shaft 31 turns in a right-handed direction, the piston 59 is driven to the right by the lip 67 in abutment against the step 66. The second, resilient pin 64 can then, by its second tooth 70, fasten onto the support 30, and the pump is then in the armed position.

In a more forward position of the camshaft 31, by rotation through an angle of about 180°, a protrusion 72 of the latter lifts the second pin 64, which triggers the partial relaxation of the spring 60 and the displacement of the piston 59 to the left until the first, outer tooth 69, protruding more than the second tooth 70, fastens onto the support 30. During this movement, the volume of the chamber 61 is suddenly increased, causing a sucking effect in the chambers 39 of the sealing members 20. The suction member 26 can thus exert a depression on the nozzles of the printheads, which leads to there being only a small amount of ink on the face of the nozzles, permitting a priming of the latter and promoting the cleaning of the front face of the printheads 11, 12 and of the nozzles during the passage over the bibs 23.

The active elements of the camshaft 31 are arranged in such a way that the complete operating cycle of the maintenance assembly stations controlled by the camshaft 31 takes place as follows:

a) idle position: the caps 21 are in the upper position, the suction member 26 is armed, the bibs 23 and the scrapers 25 are in a disengaged position, the carriage 10 is motionless in front of the maintenance assembly station 18;

b) the suction member 26 is activated, a sucking effect is produced in the chambers 39 of the caps, the nozzles are primed by depression;

c) the caps 21 move downwards and the bibs 23 move up to the active position, the carriage 10 is moved towards the printing zone; as it passes, the front part of the printheads and the nozzles are cleaned by the bibs 23;

d) the suction member 26 is rearmed; the scrapers 25 come into contact with the bibs 23 so that they can be cleaned during their downward movement;

e) the bibs 23 reach the lower position and the scrapers 25 are disengaged; the carriage is free to effect its backward and forward movement;

f) when the carriage 10 is in position facing the maintenance assembly station 18, the caps 21 are then fitted so as to be applied against the printheads 11, 12, the idle position configuration of a) is accordingly restored.

It will be obvious that the form of embodiment described is not in any way restrictive and that all the changes desired may be made to it without departing from the scope as defined in claim 1. In particular, the maintenance assembly station could be envisaged for one or three or more printheads borne by the carriage and will then comprise one or three or more maintenance assemblies.

The cams provided on the shaft 31 could be adapted differently, for example, to produce a wiping on the outbound and return movement of the carriage. The scraper could then be adapted to treat two faces of the bibs.

Other functions, such as a humidification of the front face of the heads, could be integrated in the maintenance assembly station and driven by rotation of the camshaft.

What we claim is:

1. Ink-jet printer comprising a chassis (15); a movable carriage (10) bearing at least one printhead (11, 12) and suitable for being moved according to a direction of movement (16); and a maintenance assembly station (18) consisting of at least one sealing member (20) suitable for being applied against the printhead (11, 12) and a wiping member (22) for wiping the ink off the printhead (11, 12); the maintenance assembly station (18) comprising a camshaft (31) fitting rotatingly with its axis oriented substantially parallel to the direction of movement (16) and arranged so as to activate all the movable members (20, 22) of the maintenance assembly station, wherein said maintenance assembly station (18) comprises one or more sealing members (20), one or more wiping members (22), one or more cleaning members (24) intended for removing the ink accumulated on the wiping members (22) and at least one suction member (26), connected to the sealing members (20) to produce a sucking effect therein, all these members being fitted on said maintenance assembly station (18) one after the other in said direction (16) and each being activated by elements forming cams (48, 53, 55, 67, 72) integral with the said shaft (31).

2. Printer according to claim 1, wherein the maintenance assembly station (18) comprises a module provided with a support (30) constituting the body of the module, wherein said camshaft (31) is fitted with an orientation parallel to said direction of movement (16) in a substantially central position, said sealing (20), wiping (22) and cleaning (24) members each comprising a part (35, 46, 50) fitted movably on the support (30), having a central aperture (44, 56, 73) to allow the said camshaft (31) to pass and a portion (45, 49, 52) intended for co-operating with the camshaft (31).

3. Printer according to claim 1 or 2, wherein the maintenance assembly station (18) comprises two maintenance assemblies (27, 28) each consisting of a wiping member (22), a cleaning member (24) and a sealing member (20) fitted one after the other in said direction (16), the suction member (26) being arranged between the two assemblies (27, 28).

4. Printer according to claim 2, wherein the sealing member (20) comprises a part (35) fitted slidingly on said support (30) in a direction perpendicular to the direction of movement (16), provided at its upper end with a cap (21) made of a flexible material and having a central aperture (44) enabling the passage of the camshaft (31) which co-operates with an intermediate portion (45) of this sliding part (35) urged by a spring (43) against the camshaft (31).

5. Printer according to claim 2, wherein the wiping member (22) comprises a part (46) fitted slidingly on the said support (30) in a direction perpendicular to the direction of movement (16), provided at its upper end with a flexible bib (23) and having a central aperture (56) enabling the passage of the camshaft (31) which co-operates with an intermediate portion (49) of this sliding part (46) urged by a spring (74) against the camshaft (31).

6. Printer according to claim 2, wherein the cleaning member (24) comprises a part (50) fitted pivotingly by its lower end on said support (30), provided at its upper end with a scraper (25) and having a central aperture (73) enabling the passage of the camshaft (31) which has a groove (53) forming a cam wherein a finger (52) of the pivoting part (50) is engaged.

7. Printer according to claim 2, wherein the suction member (26) comprises a cylinder (57) affixed to the support (30) and a piston (59) fitted slidingly in a direction perpendicular to the direction of movement (16), the piston being integral with an activating pin (63) arranged so as to cooperate with a nozzle (67) of the camshaft to move the piston (59) from a non-armed position to an armed position in opposition to the effect of a spring (60), the piston (59) comprising retaining means (65, 68, 70) for retaining the piston (59) in an armed position and capable of co-operating with a portion (72) of the camshaft (31) to release the piston (59) in order to create the sucking effect in the sealing members (20).

8. Printer according to claims 1 or 2, wherein the camshaft (31) is made as one piece of a moulded synthetic material.

* * * * *